US011530893B2

(12) United States Patent
Perkins, Jr.

(10) Patent No.: US 11,530,893 B2
(45) Date of Patent: Dec. 20, 2022

(54) RIFLE REST

(71) Applicant: John Raymond Perkins, Jr., Uniondale, IN (US)

(72) Inventor: John Raymond Perkins, Jr., Uniondale, IN (US)

( * ) Notice: Subject to any disclaimer, the term of this patent is extended or adjusted under 35 U.S.C. 154(b) by 0 days.

(21) Appl. No.: 17/366,607

(22) Filed: Jul. 2, 2021

(65) Prior Publication Data

US 2022/0003516 A1 Jan. 6, 2022

Related U.S. Application Data

(60) Provisional application No. 63/048,369, filed on Jul. 6, 2020.

(51) Int. Cl.
*F41A 23/02* (2006.01)
*F41A 27/24* (2006.01)
*F41A 27/22* (2006.01)

(52) U.S. Cl.
CPC ..... *F41A 23/02* (2013.01); *F41A 27/22* (2013.01); *F41A 27/24* (2013.01)

(58) Field of Classification Search
CPC ..... F41A 23/02; F41A 27/22; F41A 27/24
USPC ..... 42/94
See application file for complete search history.

(56) References Cited

U.S. PATENT DOCUMENTS 3,358,504 A * 12/1967 Freebairn ..... G02B 23/14 73/167
6,574,899 B1 * 6/2003 Mostello ..... F41A 23/16 42/94
7,730,824 B1 * 6/2010 Black ..... F41A 23/02 89/37.03
8,549,786 B1 * 10/2013 Griffith ..... F41A 23/14 42/94
9,151,562 B1 * 10/2015 Pugliese ..... F41A 23/14
9,163,893 B1 * 10/2015 Gutierrez ..... F41A 23/02
2004/0020097 A1 * 2/2004 Deros ..... F41A 23/02 42/94
2007/0169391 A1 * 7/2007 Carpenter ..... F41A 23/14 73/167
2012/0174460 A1 * 7/2012 Hicks ..... F41A 23/18 42/94
2014/0237882 A1 * 8/2014 Banes ..... F41A 23/02 42/94
2015/0226524 A1 * 8/2015 Batchvarov ..... F41A 23/02 42/94

(Continued)

*Primary Examiner* — Bret Hayes
(74) *Attorney, Agent, or Firm* — Bennet K. Langlotz; Langlotz Patent & Trademark Works, LLC

(57) ABSTRACT

Rifle rests have a base, a rifle support configured to support a forward portion of a rifle, the support movably connected to the base and operable to move vertically and laterally with respect to the base to aim the rifle, an elevation mechanism operably connecting the support to the base and having an adjustable height, a windage mechanism operable to adjust a lateral position of the rifle support with respect to the base, the windage mechanism including an arm having a forward end and opposed rear end, the forward end operably connected to the rifle support to establish a lateral position of the support based on a lateral position of the rear end of the arm, such that lateral movement of the rear end of the arm adjusts the windage of the rifle, and the elevation mechanism including an elevation control element connected to the rear end of the arm.

20 Claims, 6 Drawing Sheets

(56) References Cited

U.S. PATENT DOCUMENTS

2018/0299224 A1* 10/2018 Hutson ..... F41A 19/08

* cited by examiner

RIFLE REST

CROSS-REFERENCE TO RELATED APPLICATION

This application claims the benefit of U.S. Provisional Patent Application No. 63/048,369 filed on Jul. 6, 2020, entitled "HYBRID-X SHOOTING REST," which is hereby incorporated by reference in its entirety for all that is taught and disclosed therein.

FIELD OF THE INVENTION

The present invention relates to firearms, and more particularly to a rifle rest that enables the shooter to release the control stick without the rifle rest losing the point of aim.

BACKGROUND AND SUMMARY OF THE INVENTION

Rifle rests support an attached rifle to provide maximum accuracy and precision. The rifle rides on a front and a rear rest, which may or may not be connected. Wheel-style rests enable adjustments to the rifle's elevation (vertical position), while joystick-style rests enable the shooter to control both the elevation and windage (lateral position) of the rifle. One disadvantage of traditional joystick-style rests is the if the shooter releases the joystick, the rifle rest will move and lose the point of aim. When the point of aim is lost, it requires time to reacquire the target. Time is critical in competitive shooting because conditions can rapidly change. Being able to shoot rapidly creates better precision because there is less opportunity for conditions to change between shots.

Therefore, a need exists for a new and improved rifle rest that enables the shooter to release the control stick without the rifle rest losing the point of aim. In this regard, the various embodiments of the present invention substantially fulfill at least some of these needs. In this respect, the rifle rest according to the present invention substantially departs from the conventional concepts and designs of the prior art, and in doing so provides an apparatus primarily developed for the purpose of enabling the shooter to release the control stick without the rifle rest losing the point of aim.

The present invention provides an improved rifle rest, and overcomes the above-mentioned disadvantages and drawbacks of the prior art. As such, the general purpose of the present invention, which will be described subsequently in greater detail, is to provide an improved rifle rest that has all the advantages of the prior art mentioned above.

To attain this, the preferred embodiment of the present invention essentially comprises a base, a rifle support configured to support a forward portion of a rifle, the rifle support movably connected to the base and operable to move vertically and laterally with respect to the base to aim the rifle, an elevation mechanism operably connecting the rifle support to the base and having an adjustable height, a windage mechanism operable to adjust a lateral position of the rifle support with respect to the base, the windage mechanism including an arm having a forward end and an opposed rear end, the forward end operably connected to the rifle support to establish a lateral position of the rifle support based on a lateral position of the rear end of the arm, such that lateral movement of the rear end of the arm adjusts the windage of the rifle, and the elevation mechanism including an elevation control element connected to the rear end of the arm. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
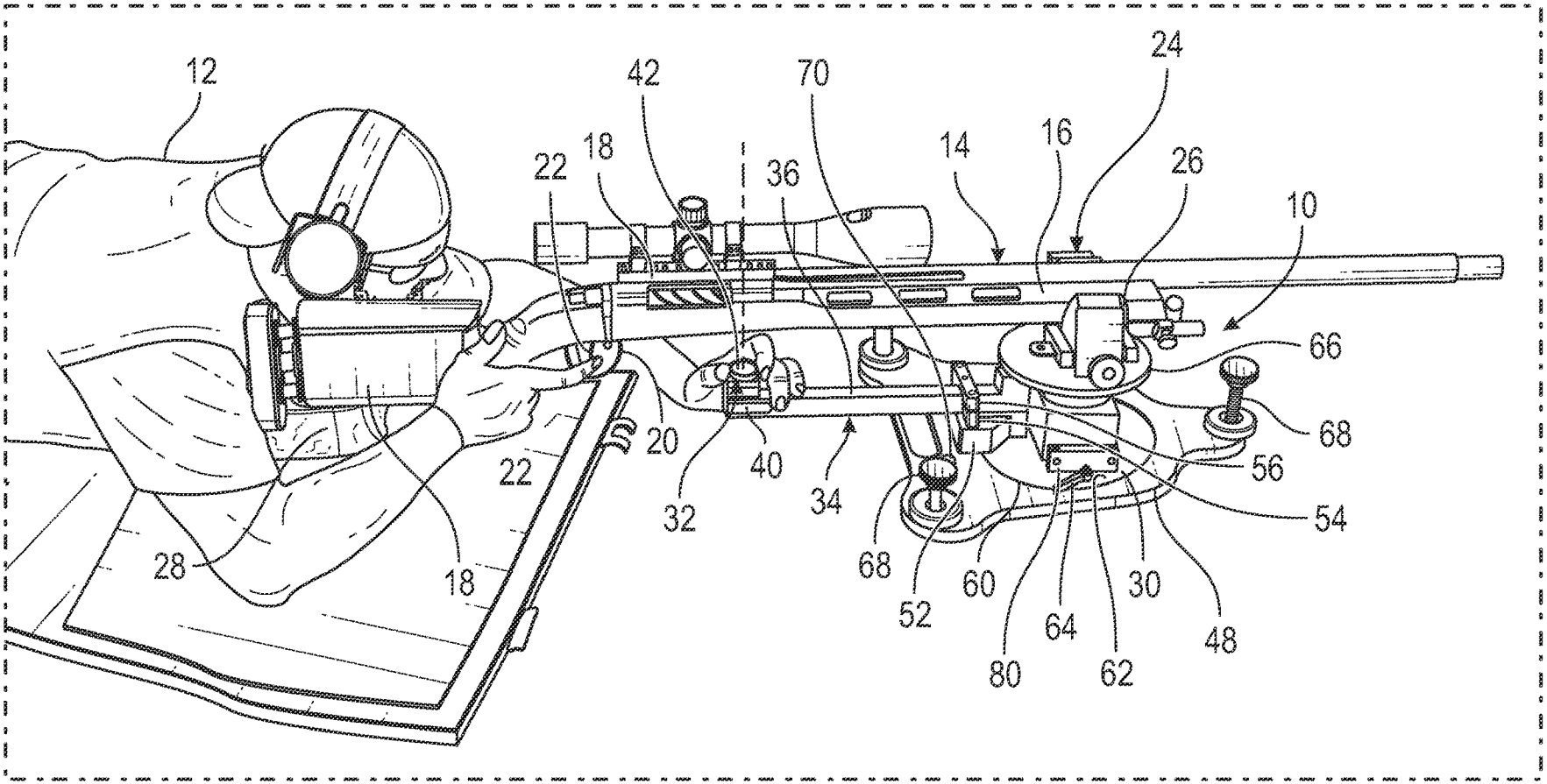
FIG. 1 is a right side view of the current embodiment of a rifle rest constructed in accordance with the principles of the present invention in use supporting a rifle.

An embodiment of the rifle rest of the present invention is shown and generally designated by the reference numeral 10.

Figure 2:
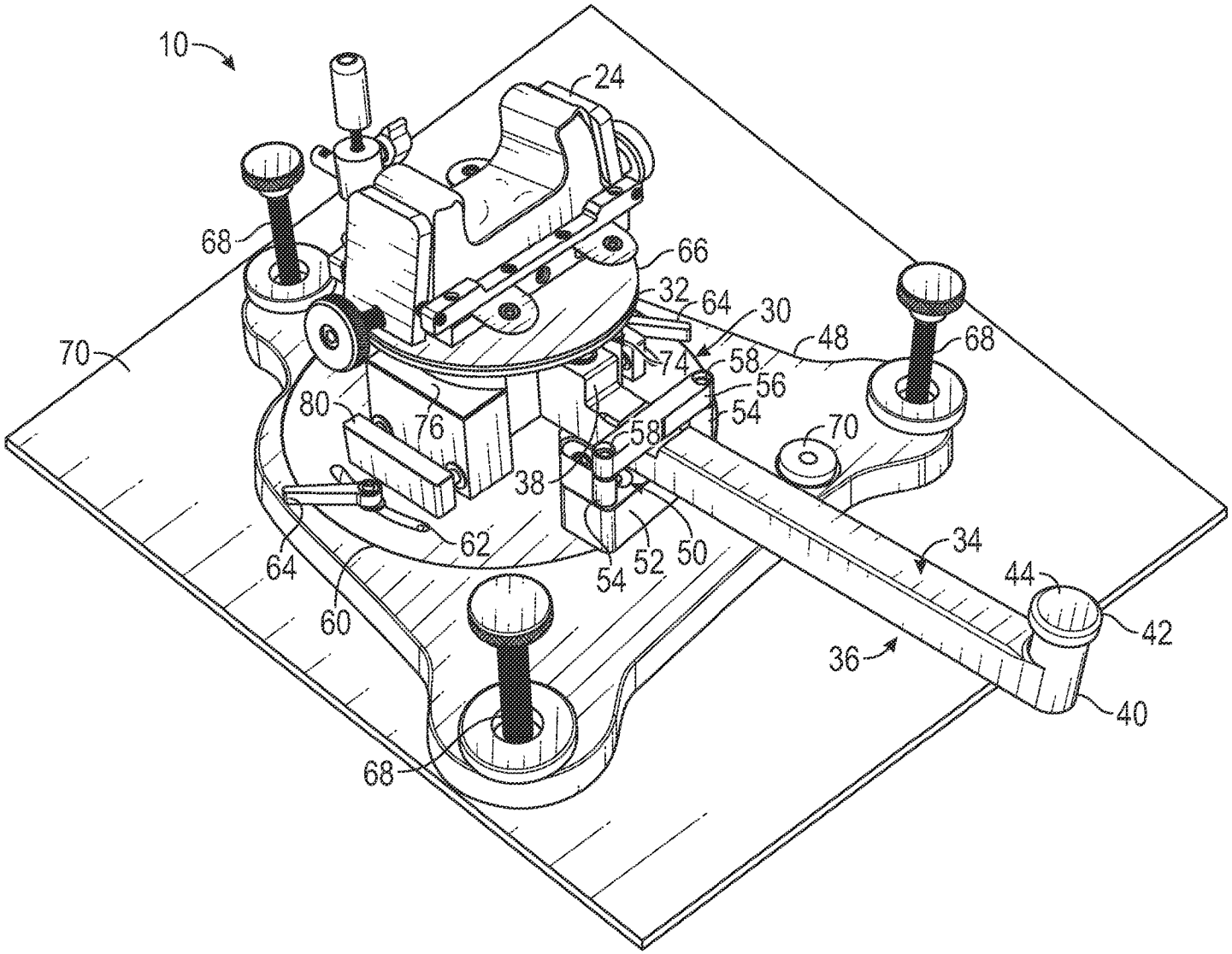
FIG. 2 is top perspective view of the rifle rest of FIG. 1.

FIGS. 1 & 2 illustrate the improved rifle rest 10 of the present invention. More particularly, FIG.

1 shows the rifle rest in use by a shooter 12 supporting a rifle 14 having a forward portion 16, a rear stock 18, and a trigger guard 20 encircling a trigger 22. The rifle rest has a rifle support 24 including a bag 26 configured to support the forward portion of the rifle. The rear stock is supported by a rear rest 28, which is not attached to the rifle rest in the current embodiment. The rifle support is movably connected to a base 30 and is operable to move vertically and laterally with respect to the base to aim the rifle. An elevation mechanism 32 operably connects the rifle support to the base and has an adjustable height. A windage mechanism 34 is operable to adjust a lateral position of the rifle support with respect to the base. It should be appreciated that both the elevation and windage mechanisms for fine adjustments to the rifle's elevation and windage are adjacent to the trigger. As a result, the shooter can rapidly transition between the shooting and adjustment positions to minimize the length of time between shots during competitive shooting.

The windage mechanism 34 includes an arm 36 having a forward end 38 and an opposed rear end 40. The forward end of the arm is operably and pivotally connected to the rifle support 24 to establish a lateral position of the rifle support based on a lateral position of the rear end of the arm, such that lateral movement of the rear end of the arm adjusts the windage of the rifle 14. The arm pivots about a vertical arm axis 46 (shown in FIG. 3). The base 30 is adjustably supported on a lower base 48, such that a rough windage position of the base relative to the lower base is established, and the windage mechanism operates to establish a fine windage position. The arm is constrained to move only in a limited lateral range of motion without vertical motion by a slot 50 defined by a stick axis block 52, two control stick lateral stops 54, and a control stick lateral stop top 56. The control stick lateral stops and control stick lateral stop top are secured to the stick axis block by two control stick lateral stop attachment screws 58. In the current embodiment, the lower base is machined out of 6061 aluminum and includes a machined cutout 60 that receives the base. The base is also machined out of 6061 aluminum in the current embodiment. Alternative versions of the base can be manufactured to enable additional types of rifle supports to be attached to the rifle rest 10.

The base 30 defines two elongated, arcuate slots 62 that each receive a lever clamp bolt 64. The lever clamp bolts are threadedly received by mounting holes in the lower base 48 (not visible). Contact between the slots and lever clamp bolts enables a range of rotational adjustment of the base with respect to the lower base to establish a rough windage position of the base relative to the lower base. The lever clamp bolts are then tightened to prevent undesired rotation of the base relative to the lower base.

The elevation mechanism 32 includes an elevation control element 42 connected to the rear end 40 of the arm 36. In the current embodiment, the elevation control element is a rotatable elevation control knob. The rotatable elevation control knob rotates on a vertical axis 44. The elevation control mechanism is configured to retain the rifle support 24 in a selected elevation position in the absence of contact or force by the shooter 12. The elevation control element is used for fine adjustments of the elevation position. An elevation handwheel 66 is also part of the elevation mechanism to enable large adjustments of the elevation position.

The lower base 48 includes three thumbscrews 68, which are used to level the lower base on a shooting surface 70. The lower base has a bubble level 72 to enable the shooter 12 to determine when the lower base is level.

Figure 3:
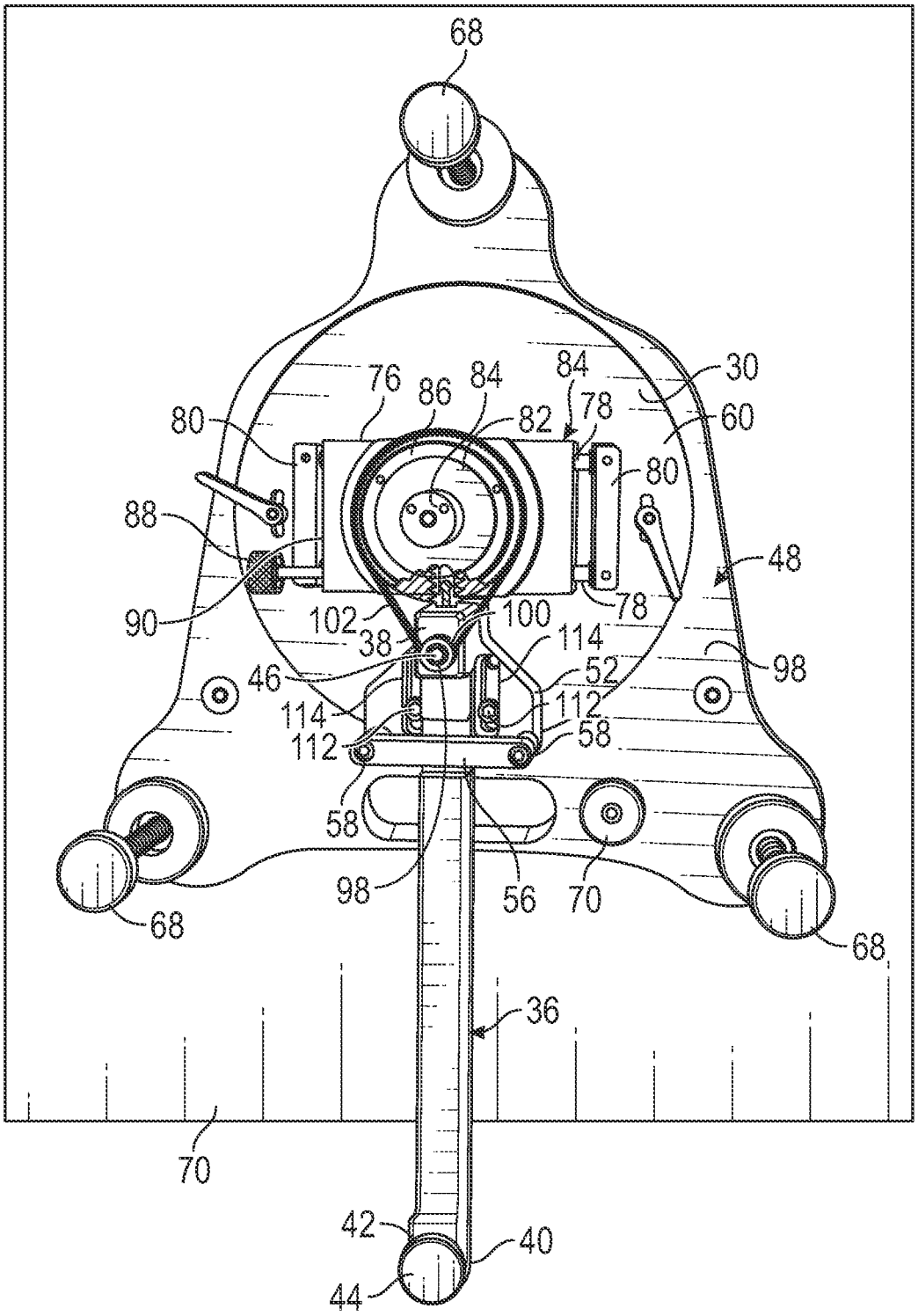
FIG. 3 is a top isometric view of the rifle rest of FIG. 1 with the cradle and elevation hand wheel removed.
Figure 4:
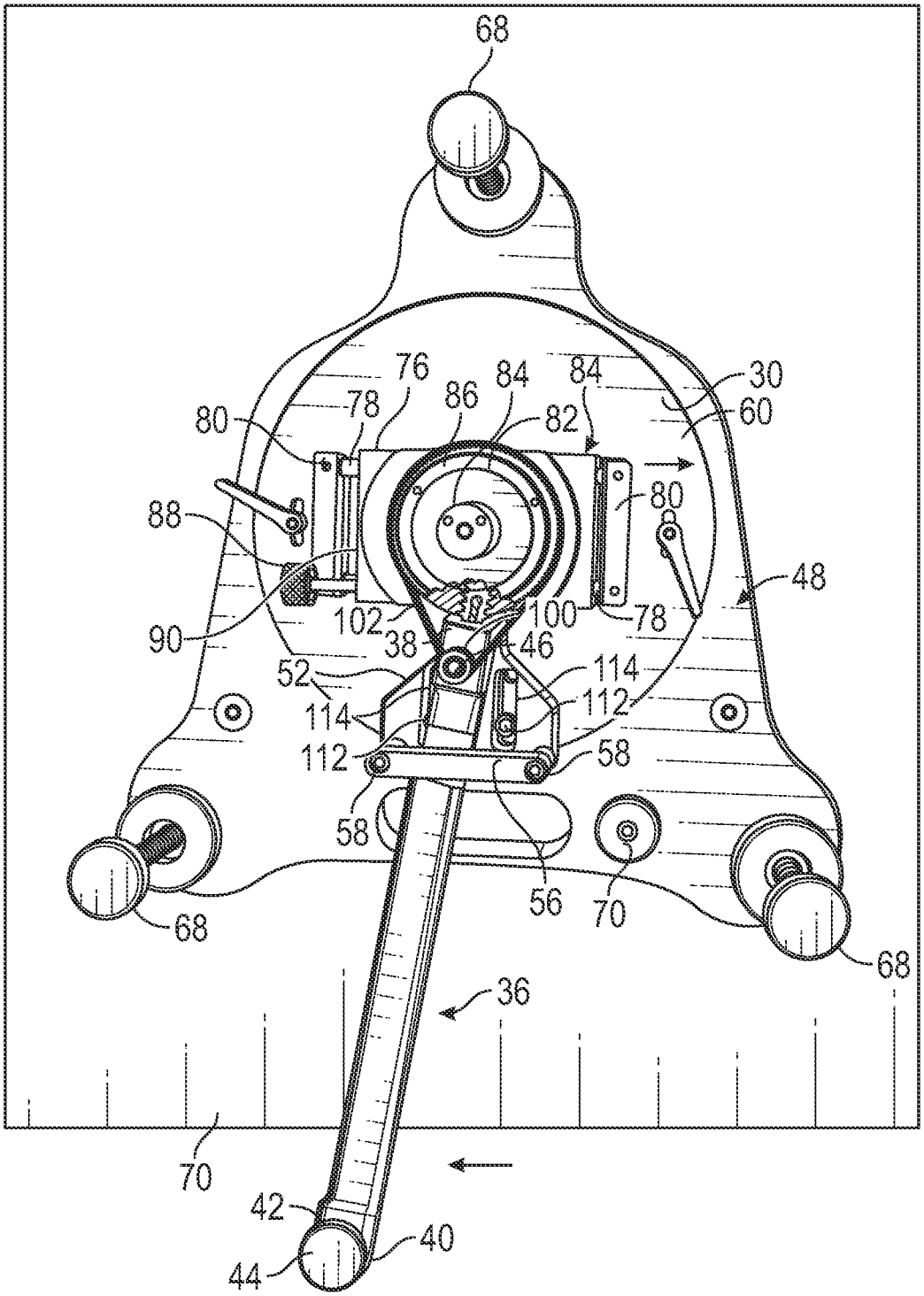
FIG. 4 is a top isometric view of the rifle rest of FIG. 1 with the cradle and elevation hand wheel removed showing a windage adjustment relative to the position shown in FIG. 3.
Figure 6:
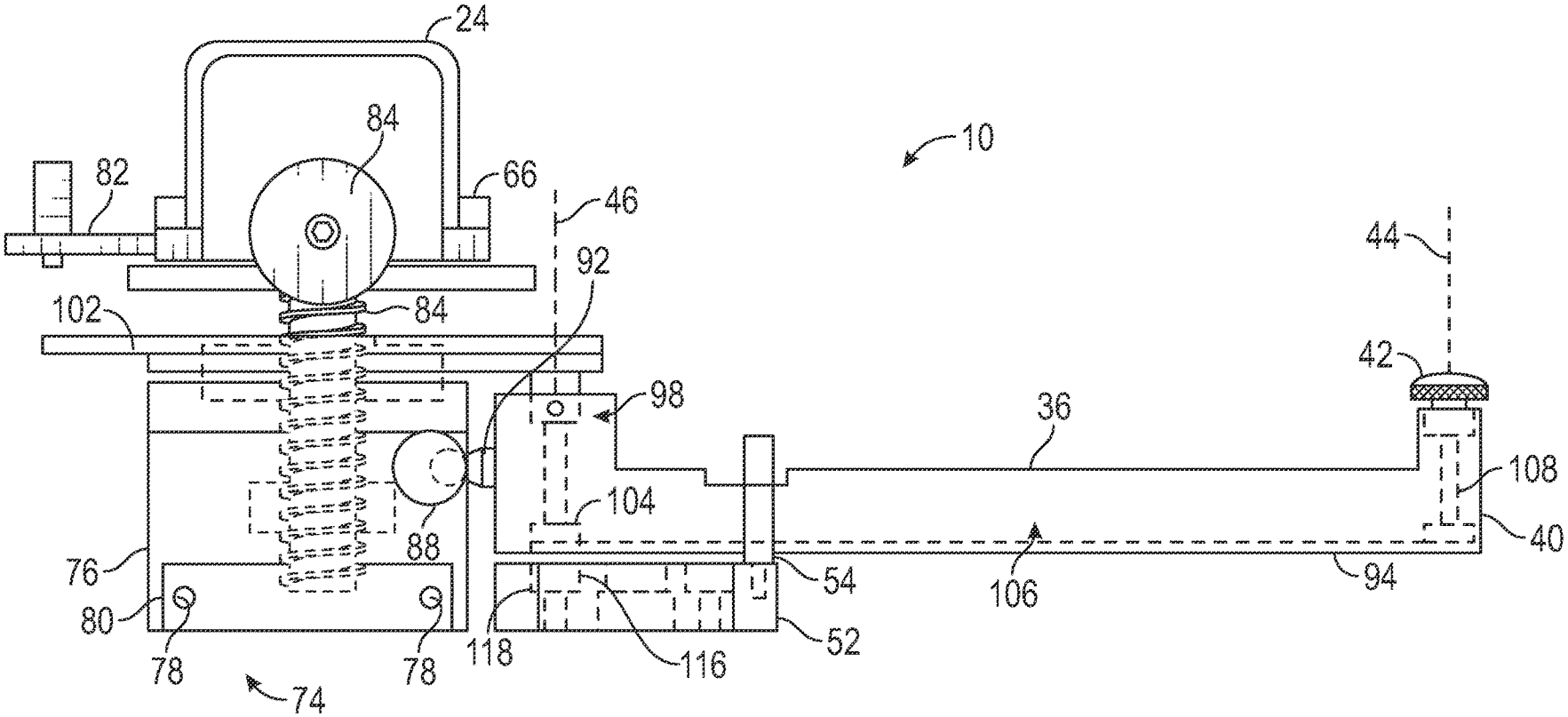
FIG. 6 is a side sectional view of the rifle rest of FIG. 1.

FIGS. 3, 4 & 6 illustrate the improved rifle rest 10 of the present invention. More particularly, FIGS. 3 & 4 show the rifle rest with the rifle support 24 and elevation handwheel 66 removed to expose the central block assembly 74, which is mounted on the base 30. FIG. 6 shows the rifle rest with the rifle support and elevation handwheel attached. FIG. 3 shows the arm 36 in an approximately centered position of windage adjustment of the central block assembly. FIG. 4 shows the arm pivoted to left to create the maximum amount of windage adjustment to the right of the central block assembly. The central block assembly has a central block 76 that floats on a pair of windage rails 78 using four linear roller bearings (not visible) incorporated into the central block. The windages rails are mounted on the base by two rail attachment blocks 80 secured by screws. The rail attachment blocks also serve as stops to limit the range of windage adjustment of the central block assembly.

The central block 76 defines a central bore (not visible) that receives an elevation ball screw bearing block 82, post alignment bearing block (not visible), and a main elevation ball screw post 84 that is driven by the elevation gear 86. The rifle support 24 is connected to the main elevation ball screw post. A windage axis ball socket tension control thumbscrew 88 protrudes from the left side 90 of the central block. The central block also defines a windage axis ball socket 120 made of that receives a windage axis ball link 92 on the forward end 38 of the arm 36. In the current embodiment, the windage axis ball socket is made of polyoxymethylene for low-friction and high-wear resistance combined with high strength and stiffness. The windage axis ball socket tension control thumbscrew enables the shooter 12 to control the tension of the arm while the windage axis ball link is received in the windage axis ball socket to prevent inadvertent adjustment of the arm when the shooter is not contacting the arm.

An elevation control shaft 98 that is rotatable about the vertical arm axis 46 protrudes upwardly from the forward end 38 of the arm 36. An elevation belt sprocket 100 is rotatably mounted on the elevation control shaft. A belt 102 connects the elevation belt sprocket to the elevation gear 86 to interconnect the elevation control element 42 to the rifle support 24 in a manner which will be subsequently described in the description of FIG. 5. Tension of the belt is adjusted by sliding the stick axis block 52 forward and rearward into a selected position, and then securing the stick axis block to the base 30 using four bolts 112 (two are visible) inserted into counterbored slots 114. Because the arm is connected to the central block 76 by the insertion of the windage axis ball link into the windage axis ball socket forming a ball-and-socket joint, the function of the arm remains unchanged regardless of the forward/rearward position of the stick axis block relative to the central block. The stick axis block also contains two ball bearings (not shown) that receive the elevation control shaft to provide smooth pivoting movement of the arm and enable the elevation control shaft to spin freely free from engagement with the belt. The elevation control shaft serves as the fulcrum pivot point for the movement of the central block assembly 74 when the arm is manipulated by the shooter 12. A lock nut 116 is attached to the bottom portion 118 of the elevation control shaft to hold the arm and the stick axis block together.

Figure 5:
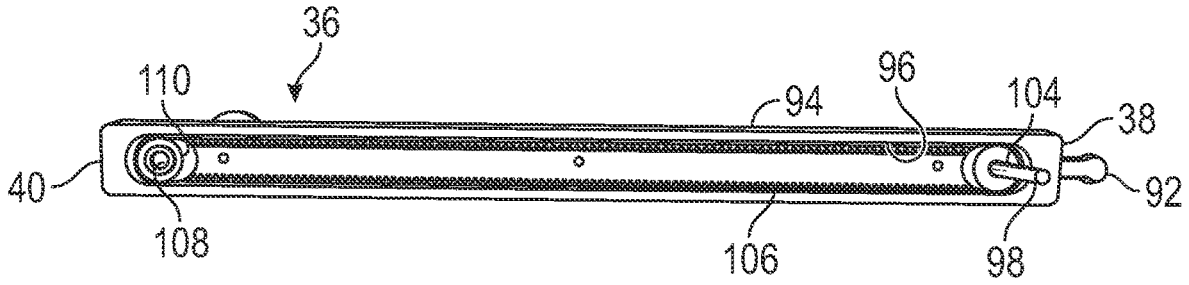
FIG. 5 is a bottom view of the control stick of FIG. 1.

FIG. 5 illustrates the improved arm 36 of the present invention. More particularly, the arm has a bottom 94 that defines an elongate slot 96 that extends from the forward end 38 to the rear end 40. The elevation control shaft 98 is received in the forward end of the elongate slot. A lower elevation sprocket 104 is rotatably mounted on the elevation control shaft within the forward end of the elongate slot. An elongated drive loop 106 in the form of a belt extends along the arm within the elongate slot and is connected to the lower elevation sprocket. An elevation axle 108 is received in the rear end of the elongate slot. A second lower elevation sprocket 110 is rotatably mounted on the elevation axle within the rear end of the elongate slot. The elongated drive loop is also connected to the second lower elevation sprocket. The elevation control element 42 is connected to a portion of the elevation axle that protrudes upwardly from the rear end of the arm. Thus, the elevation control element is connected to the rifle support 24 via the elongated drive loop, belt 102, elevation gear 86, and main elevation ball screw post 84. Furthermore, via the same components that form the elevation control mechanism, the elevation handwheel 66 rotates the elevation control element when the shooter 12 rotates the elevation handwheel. In addition, the drive loop engages an elevation control knob (elevation control element) at the rear of the arm and a shaft (elevation control shaft) proximate the forward end of the arm, the shaft operable to establish a height of the rifle support. It should be appreciated that the elongate slot is covered by a protective access plate to keep dust and debris out. The shooter rotates the elevation control element counterclockwise to lower the main elevation ball screw post and rotates the elevation control element clockwise to rase the main elevation ball screw post. The use of a ball screw post provides consistent movement qualities while elevation is adjusted even when weight is being applied downwardly by the rifle 14 and rifle support 24. In the current embodiment, the rifle support is attached to the main elevation ball screw post by three stainless steel bolts.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a rifle rest has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle rest comprising:

a base;

a rifle support configured to support a forward portion of a rifle;

the rifle support movably connected to the base and operable to move vertically and laterally with respect to the base to aim the rifle;

an elevation mechanism operably connecting the rifle support to the base and having an adjustable height;

a windage mechanism operable to adjust a lateral position of the rifle support with respect to the base;

the windage mechanism including an arm having a forward end and an opposed rear end, the forward end operably connected to the rifle support to establish a lateral position of the rifle support based on a lateral position of the rear end of the arm, such that lateral movement of the rear end of the arm adjusts the windage of the rifle;

the arm being connected to the rifle support only and the forward end; and the elevation mechanism including an elevation control element connected proximate to the rear end of the arm.

2. The rifle rest of claim 1 wherein the elevation control mechanism is configured to retain the rifle support in a selected elevation position in the absence of user contact or force.

3. The rifle rest of claim 1 wherein the elevation control element is a rotatable knob.

4. The rifle rest of claim 3 wherein the rotatable knob operates to rotate on a vertical axis.

5. The rifle rest of claim 1 wherein the arm is pivotally connected to the base.

6. The rifle rest of claim 5 wherein the arm pivots about a vertical arm axis.

7. The rifle rest of claim 6 including an elevation control shaft rotatable about the vertical arm axis and interconnecting the elevation control element to the rifle support.

8. The rifle rest of claim 1 wherein the arm is constrained to move only in a lateral range of motion without vertical motion.

9. The rifle rest of claim 1 wherein the elevation mechanism includes an elongated drive loop extending along the arm.

10. The rifle rest of claim 9 wherein the drive loop is a belt.

11. The rifle rest of claim 9 wherein the drive loop engages an elevation control knob at the rear of the arm and a shaft proximate the forward end of the arm, the shaft operable to establish a height of the rifle support.

12. The rifle rest of claim 1 wherein the base is adjustably supported on a lower base, such that a rough windage position of the base relative to the lower base is established, and the windage mechanism operates to establish a fine windage position.

13. A rifle rest comprising:

a base;

a rifle support configured to support a forward portion of a rifle;

the rifle support movably connected to the base and operable to move vertically and laterally with respect to the base to aim the rifle;

an elevation mechanism operably connecting the rifle support to the base and having an adjustable height;

a windage mechanism operable to adjust a lateral position of the rifle support with respect to the base;

the windage mechanism including an arm having a forward end and an opposed rear end, the forward end operably connected to the rifle support to establish a lateral position of the rifle support based on a lateral position of the rear end of the arm, such that lateral movement of the rear end of the arm adjusts the windage of the rifle; and the elevation mechanism including an elevation control element connected proximate to the rear end of the arm, the elevation control element being operably connected to the elevation mechanism by an elongated drive extending along the arm.

14. The rifle rest of claim 13 wherein the elongated drive includes an elongated drive loop extending along the arm.

15. The rifle rest of claim 14 wherein the elongated drive loop is a belt.

16. The rifle rest of claim 14 wherein the elongated drive loop engages an elevation control knob at the rear of the arm and a shaft proximate the forward end of the arm, the shaft operable to establish a height of the rifle support.

17. A rifle rest comprising:

a base;

a rifle support configured to support a forward portion of a rifle;

the rifle support movably connected to the base and operable to move vertically and laterally with respect to the base to aim the rifle;

an elevation mechanism operably connecting the rifle support to the base and having an adjustable height;

a windage mechanism operable to adjust a lateral position of the rifle support with respect to the base;

the windage mechanism including an arm having a forward end and an opposed rear end, the forward end operably connected to the rifle support to establish a lateral position of the rifle support based on a lateral position of the rear end of the arm, such that lateral movement of the rear end of the arm adjusts the windage of the rifle;

the rear end of the arm being movable laterally with respect to the rifle support; and the elevation mechanism including an elevation control element connected to the rear end of the arm.

18. The rifle rest of claim 17 wherein the elevation control mechanism is configured to retain the rifle support in a selected elevation position in the absence of user contact or force.

19. The rifle rest of claim 17 wherein the elevation control element is a rotatable knob.

20. The rifle rest of claim 19 wherein the rotatable knob operates to rotate on a vertical axis.

* * * * *